United States Patent [19]

Kardol et al.

[11] 3,959,187

[45] May 25, 1976

[54] MIXED SYNTHETIC ESTER LUBRICANTS AS USEFUL POLYMERIC FIBER LUBRICANTS

[75] Inventors: Arie Dick Kardol; Adrianus Trapman, both of Waddinxveen; Gijsbert van der Waal, Bergambacht, all of Netherlands

[73] Assignee: Emery Industries, Inc., Cincinnati, Ohio

[22] Filed: Dec. 19, 1974

[21] Appl. No.: 534,249

[30] Foreign Application Priority Data

Dec. 28, 1973 United Kingdom ..... 60077/73

[52] U.S. Cl. ..... 252/56 S; 252/8.9; 252/49.5

[51] Int. Cl.[2] ..... C10M 1/24

[58] Field of Search ..... 252/8.9, 49.5, 56 S

[56] References Cited

UNITED STATES PATENTS

| | | | |
|---|---|---|---|
| 2,570,037 | 10/1951 | Smith et al. | 252/56 S X |
| 3,048,623 | 8/1962 | Matuszak et al. | 252/56 S X |
| 3,641,073 | 2/1972 | Buckley | 252/8.9 X |
| 3,649,570 | 3/1972 | Boehringer | 252/56 S |
| 3,694,257 | 9/1972 | Dumont | 252/8.9 X |
| 3,769,215 | 10/1973 | Sturwold et al. | 252/56 S X |
| 3,850,682 | 11/1974 | Sturwold et al. | 252/56 S X |

*Primary Examiner*—Delbert E. Gantz
*Assistant Examiner*—Andrew H. Metz
*Attorney, Agent, or Firm*—Gerald A. Baracka; John D. Rice

[57] ABSTRACT

Improved water-emulsifiable ester lubricants for polymeric and metal materials are provided which yield stable emulsions even in the absence of emulsifying agents. The ester lubricants are obtainable from a higher molecular weight di- or polycarboxylic acid and a polyalkoxylated lower alkyl alcohol.

5 Claims, No Drawings

MIXED SYNTHETIC ESTER LUBRICANTS AS USEFUL POLYMERIC FIBER LUBRICANTS

BACKGROUND OF THE INVENTION

Various water-emulsifiable synthetic esters have been suggested as lubricants for fibers but they are not without certain disadvantages. Some of these synthetic esters are viscous liquids and require the use of additional emulsifying agents because otherwise they give relatively unstable emulsions, whereas certain others contain a plurality of free functional groups such as hydroxyl groups, and are thermally unstable. Heretofor it has not been possible to produce low viscosity synthetic lubricants showing a good combination of lubricating efficiency and emulsifiability in water and thermo-stability, i.e. resistance against degradation due to heating under lubricating conditions.

SUMMARY OF THE INVENTION

It has now been found that certain esters containing groups obtainable from a high molecular weight di- or polycarboxylic acid and a polyalkoxylated lower alkyl alcohol are excellent water-emulsifiable lubricants. The esters of this invention are obtained from a poly ($C_2$–$C_3$) alkoxylated lower $C_1$–$C_6$ alkyl alcohol and a polycarboxylic acid containing 2 to 4 carboxyl groups and 20–80 carbon atoms and correspond to the general formula:

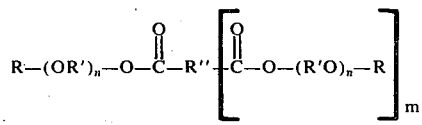

wherein R represents a $C_1$–$C_6$, preferably $C_1$–$C_3$, alkyl group, R′ represents a $C_2$–$C_3$ alkylene group, *n* represents an integer from 4–20, preferably from 5–9, R″ represents a hydrocarbon group containing 20–80, preferably 32–60, carbon atoms and *m* represents an integer from 1–3.

DETAILED DESCRIPTION

Ester lubricants of this invention are represented by the general formula:

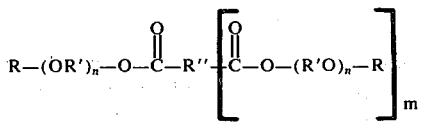

wherein R represents a $C_1$–$C_6$, preferably $C_1$–$C_3$, alkyl group;

R′ represents a $C_2$–$C_3$ alkylene group;

*n* represents an integer from 4–20, preferably from 5–9;

R″ represents a hydrocarbon group containing 20–80, preferably 32–60, carbon atoms; and

*m* represents an integer from 1–3.

*n* and *m* represent integers when considered per molecule or in pure compounds, however, if technical grade starting materials are used their average values need not be integers.

It is convenient to obtain these di- or polycarboxylic acid esters by esterification or interesterification from a polyalkoxylated alkyl alcohol of the structure R — $(OR')_n$ — OH, such as $CH_3O(CH_2-CH_2O)_7H$ — Carbowax methoxypolyethylene glycol-350, a commercially available product of the Union Carbide Corporation, or a lower carboxylic acid ester thereof and a polycarboxylic acid of the structure

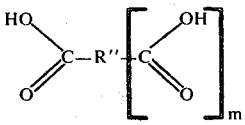

or a lower alkyl ester thereof. The symbols R, R′, R″, *n* and *m* have been defined above. The lower carboxylic acid and lower alkyl ester preferably contain 1–4 carbon atoms in the molecule. Very suitable di- or polycarboxylic esters are obtained from polyethoxylated methanol containing an average of 5–8 ethoxy groups in the molecule and polymerized fatty acids obtained from $C_{12}$–$C_{24}$ unsaturated fatty acids, such as Empol 1018 and 1040, polymerized $C_{16}$–$C_{18}$ fatty acids manufactured by Unilever-Emery N. V., Gouda, The Netherlands, or Emery Industries Inc., Cincinnati, Ohio, USA. The esterification or interesterification reactions are optionally carried out in the presence of a catalyst by methods and under conditions known in the art. The acid number and hydroxyl value of these esters should be below 20, preferably below 15.

In order to obtain satisfactory aqueous lubricants it is desirable that these esters are balanced as to their hydrophylic and hydrophobic properties. The hydrophylic properties are imparted by the oxyalkylene groups (OR′) and the number of these groups in the molecule (n) together with the number of carbon atoms in the alkylene group (R′). The hydrophobic properties are imparted by the number of carbon atoms in the polycarboxylic acid residue (R″) and the number of carbon atoms in the alkyl group R.

Thus it has been found that excellent water-emulsifiable esters are obtained in cases where R contains 1–3 carbon atoms; R′ contains 2 carbon atoms, *n* represents an integer from 5–8, in particular 7–8 and R″ contains 30–40 carbon atoms and *m* is 1. It is desirable that in cases where R″ contains more carbon atoms more oxyalkylene groups are present, whereas when R″ contains fewer carbon atoms less oxyalkylene groups are present.

In a particularly preferred embodiment of the invention the abovementioned esters are used in combination with another monocarboxylic acid ester of the structure

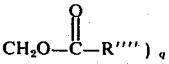

in which R′′′′ represents an alkyl group containing 6–12 carbon atoms and R′′′ represents an alkyl group containing 1–4, preferably 1–2 carbon atoms and *p* and *q* represent whole numbers from 0–2 and 2–4 respectively with the proviso that $p+q=4$. Particularly preferred monocarboxylic acid esters of this type are obtainable from $C_7$–$C_{12}$ monocarboxylic acids, e.g. coconut fatty acids, heptanoic acid, pelargonic acid or from their lower alkyl esters and polyhydric alcohols, preferably with no hydrogen atoms in the beta position, such as neopentylglycol, pentaerythritol, trimethylol ethane and trimethylol propane, or lower carboxylic acid esters thereof by esterification or interesterification reactions known in the art. The acid number and hydroxyl value of these esters should be below 8, preferably below 3.

Ester compositions containing 20–100% by weight of the di- or polycarboxylic acid ester and 0–80% by weight of the monocarboxylic acid ester are suitable, whereas respective % ranges of 25–45 and 55–75 are preferred where combinations of dicarboxylic acid esters and monocarboxylic acid esters are used, a slightly less hydrophylic dicarboxylic acid ester than when used singly is preferred so that these esters when used in combination referred to above generally contain 1 to 2 oxyalkylene groups less in the polyoxyalkylene and *n* is 1 or 2 lower than in the preferred ranges indicated above.

The invention thus provides dicarboxylic acid esters of low viscosity and mixtures thereof with monocarboxylic acid esters which are readily emulsifiable with water in the absence of additional emulsifying agents to yield stable emulsion when added to water and stirred in amounts of 0.1 to 25%, preferably 5 to 20%, by weight of the emulsion and which aqueous emulsions can be successfully used in various metal working operations and as fiber finishes. They can be applied by spraying, immersion or similar methods and reduce friction and heat build-up and as a result of their thermal stability. These esters do not accumulate unduly on the various parts of the apparatus so that the necessity of discontinuing the metal or fiber processing for cleaning purposes is reduced and the throughput increased. In the aqueous emulsion lubricants other additives are generally also employed, such as stabilizers, corrosion inhibitors, etc.

The following Examples illustrate the invention.

EXAMPLE I

In a four-necked 1 liter flask, provided with a mechanical stirrer, a thermometer, a gas inlet pipe and a Dean Stark trap with a vertically arranged water condensor, 435 g (1.5 equivalents) dimer acid (commercially available Empol 1018 which contained about 83% by weight of $C_{36}$ dicarboxylic acid) and 378 g (1.5 equivalents) ethoxylated methanol with a molecular weight of 252 ($CH_3OH.5EO$ in which EO stands for ethylene oxide) were introduced. With stirring, the reaction mixture was gradually heated to 225°C with the aid of an electrical heating mantle. To avoid discoloration and to carry off water formed during the reaction, nitrogen was passed through particularly towards the end of the esterification. At about 150°C reaction water began to develop which after condensation in the condensor, was collected in the Dean Stark trap. The progress of the reaction was followed by means of the decrease in acid value. The esterification was continued until the acid value had dropped below 15 and 23 mls reaction water was collected.

The light-brown colored end product contained 4% by weight unreacted polyethoxylated methanol and 56.3% of combined dimer acid. The product, with an acid value of 14.1, a hydroxyl value of 9 and a viscosity at 210°F (approx. 99°C) of 19.4 centistokes, was dispersible in water and miscible in all ratios with the pelargonic acid esters of pentaerythritol as well as with the esters of timethylol propane.

EXAMPLE II

In the apparatus as described in Example I, 290 g (1 equivalent) of dimer acid (Empol 1018) and 40 g (1 equivalent) of a polyethoxylated methanol with the molecular weight of 340 ($CH_3OH.7EO$) were esterified as described in Example I. In total 16.5 mls reaction water were collected. The light-brown low viscous end-product contained 7.9% by weight unreacted polyethoxylated methanol and 17.2% by weight reacted dimer acid. The product showed the following analytical characteristics: acid value 6.8, hydroxyl value 13 and a viscosity at 210°F (approx. 99°C) of 21.5 centistokes.

EXAMPLE III

In the apparatus as described in Example I, 435 g (1.5 equivalents) trimer acid (Empol 1040, which contained at most 20% by weight of dimer acid at least 80% by weight of trimer and high polymeric acids) were esterified with 378 g (1.5 equivalents) ethoxylated methanol with a molecular weight of 252 ($CH_3OH.5EO$). The esterification reaction was carried out as described in Example I. In total 23 mls of reaction water were collected. The dark-brown colored end-product, which proved to be dispersible in water, only contained 4.9% by weight unreacted polyethoxylated methanol and 56.4% by weight reacted polymer (trimer) acid and had the following analytical characteristics: acid value 14.1, hydroxyl value 11, viscosity at 210°F (approx. 99°C) 26.4 centistokes.

EXAMPLE IV

In the apparatus as described in Example I, 240 g (1 equivalent) trimer acid (Empol 1040, which contained at most 20% by weight of dimer acid and at least 80% by weight of trimer and higher polymeric acids) were esterified with 340 g (1 equivalent) polyethoxylated methanol with a molecular weight of 340 ($CH_3OH.7EO$) in the way as described in Example I. In total 15.5 mls reaction water were collected. The dark-brown colored end-product contained still 10.3% by weight unreacted polyethoxylated methanol and 47.2% by weight reacted polymeric acid and had the following analytical characteristics:. acid value 12.3, hydroxyl value 17, viscosity at 210°F (approx. 99°C) 26.4 centistokes.

EXAMPLE V

In an apparatus as described in Example I, 102 g of pentaerythritol (0.75 moles) and 592.5 g (3.75 moles) of pelargonic acid Emfac 1202 manufactured by Unilever-Emery N. V., Gouda, The Netherland, were heated to 250°C while passing through a stream of nitrogen gas. At about 150°C reaction water began to evolve and was distilled off. Some of the pelargonic acid distilled too and after separation in the Dean Stark apparatus was recycled into the reaction mixture. Heating was continued to 250°C. The course of the reaction was followed by determination of acid- and hydroxyl values. The reaction was finished when the hydroxyl value had dropped below 5. The acid value was then about 65. About 54 mls of reaction water had been collected.

The excess of pelargonic acid was distilled off in vacuum until an acid value of about 1 had been reached. After cooling till room temperature, 65 parts by weight of this pentaerythritol ester was mixed with 35 parts by weight of the product described in Example I.

EXAMPLE VI

In an apparatus as described in Example I, 134 g of trimethylol propane (1 mol) and 692.5 g of pelargonic acid Emfac 1202 were esterified as described in Example V. When the hydroxyl value had reached a value below 5, the acid value was about 62 and approximately 54 mls of reaction water had been collected. After distilling off the excess of pelargonic acid in vacuum and cooling, 65 parts by weight of this trimethylol propane ester were mixed with 35 parts by weight of the product mentioned in Example I.

EXAMPLE VII

In order to test the water solubility of the product described in the Examples I to IV, 10 g of these esters were stirred into 90 g of water at room temperature. The products of the Example II and IV gave practically clear solutions while the products of the Example I and III gave very stable dispersions.

EXAMPLE VIII

In order to compare the miscibility of the product of the Examples I to IV with that of a well-known emulsifier for lubricants atlas-G 1086 (polyoxyethylenesorbitan mono-oleate 4/5 EO from Atlas Chemie G.m.b.H., Essen, Germany), in each case in combination with monocarboxylic acid ester lubricants, mixtures were prepared with the pelargonic esters of pentaerythritol and the ester of trimethylpropane. All products were found to be miscible in all ratios with the mentioned monocarboxylic ester lubricants.

EXAMPLE IX

In order to test the emulsifying properties of the product of the Examples I to IV and the well-known emulsifier Atlas-G 1086, 35 g of these products were mixed with 65 g of the pelargonic ester of pentaerythritol. Ten g of these mixtures were stirred into 90 g of water at room temperature. Very stable emulsions were obtained with the products of the Examples I and III and with Atlas-G 1086. The emulsions obtained with the products of Examples II and IV were slightly less stable.

EXAMPLE X

The thermal stability was tested of the product of the Examples V and VI in comparison with a mixture of 35 parts by weight of Atlas-G 1086 and 65 parts by weight of the pelargonic ester of pentaerythritol. A Panel Coker, Model C obtained from Roxana Machine Works, Roxana, Ill., U.S.A., was used as described in U.S. Federal Test Method Standards No. 791 B, method 3462.

This apparatus offers a means, by splashing a test lubricants onto a hot metal surface, to determine the amount of coke or varnish which is formed on the surface. The test gives a good measure of the pollution of the hot plate during texturizing of synthetic filament yarns. Test conditions and results were as follows:

Panel temperature: 232°C
Lubricant temperature: 149°C
Air temperature: 204°C
Air rate: 0.4 l/min
Time: 8 hours Test 1 — the product of Example V (a combination of a mono-carboxylic acid ester and a dicarboxylic acid ester)

Test 2 — the products of Example VI (a combination of a mono-carboxylic acid ester and a dicarboxylic acid ester)

Test 3 — Atlas-G 1086/pentaerythritol pelargonate 35/65 parts by weight.

| | Test No. 1 | 2 | 3 |
|---|---|---|---|
| Weight of coke on hot plate after lightly cleaning with a water-wetted piece of wadding (in mg) | 18 | 17 | 32 |
| Viscosity at 210°F (approx. 100°C) of the starting material (in centistokes) | 10.9 | 8.7 | 9.0 |
| Viscosity increase at 210°F (approx. 100°C) (in %) | 26 | 17 | 53 |
| Viscosity at 100°F (approx. 38°C) of the starting material (in centistokes) | 66.7 | 48.8 | 53.0 |
| Viscosity increase at 100°F (approx. 38°C) (in %) | 55 | 32 | 127 |
| Viscosity index before the test (A.S.T.M.D. 2270) | 165 | 171 | 161 |
| Viscosity index decrease after the test | 21 | 14 | 39 |
| Emulsion stability before the test | good | good | good |
| Emulsion stability after the test | good | good | good |

We claim:

1. A synthetic ester lubricant charactericized by having good thermal stability and emulsifiability in water comprising 25–45 % by weight of a polycarboxylic acid ester obtained from a poly($C_2$–$C_3$) alkoxylated lower $C_1$–$C_6$ alkyl alcohol and a polycarboxylic acid containing 2–4 carboxyl groups and 20–80 carbon atoms and having the formula

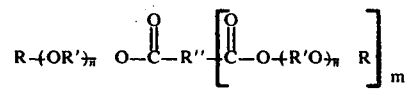

wherein R represents a $C_1$–$C_6$ alkyl group, R′ represents a $C_2$–$C_3$ alkylene group, *n* represents an integer from 4–20, R″ represents a hydrocarbon group containing 20–80 carbon atoms and *m* represents an integer from 1–3, said polycarboxylic acid ester having an acid number and hydroxyl value less than 20, and 55–75% by weight of a monocarboxylic acid ester corresponding to the structural formula $$(R'''\rangle_p\ C\langle CH_2O-\overset{O}{\overset{\|}{C}}-R'''')_q$$

in which R'''' represents an alkyl group containing 6–12 carbon atoms, R''' represents an alkyl group containing 1–4 carbon atoms and $p$ and $q$ represent whole numbers from 0–2 and 2–4, respectively, with the proviso that $p+q=4$, said monocarboxylic acid ester having an acid number and hydroxyl value less than 8.

2. The ester lubricant of claim 1 wherein R is a $C_1$–$C_3$ alkyl group, $n$ is 5–9 and R'' contains 32–60 carbon atoms.

3. The ester lubricant of claim 2 wherein the acid number and hydroxyl value of the polycarboxylic acid ester are less than 15 and the acid number and hydroxyl value of the monocarboxylic acid ester are less than 3.

4. A method for lubricating polymeric fibers which comprises treating the fiber with a synthetic ester containing 25–45% by weight of a polycarboxylic acid ester obtained from a poly ($C_2$–$C_3$) alkoxylated lower $C_1$–$C_6$ alcohol and a polycarboxylic acid containing 2–4 carboxyl groups and 20–80 carbon atoms and having the formula $$R\langle OR'\rangle_n\ O-\overset{O}{\overset{\|}{C}}-R''\left[\overset{O}{\overset{\|}{C}}-O\langle R'O\rangle_n\ R\right]_m$$

wherein R represents a $C_1$–$C_6$ alkyl group, R' represents a $C_2$–$C_3$ alkylene group, $n$ represents an integer from 4–29, R'' represents a hydrocarbon group containing 20–80 carbon atoms and $m$ represents an integer from 1–3, said polycarboxylic acid ester having an acid number and hydroxyl value less than 20, and 55–75% by weight of a monocarboxylic acid ester corresponding to the structural formula $$(R'''\rangle_p\ C\langle CH_2O-\overset{O}{\overset{\|}{C}}-R'''')_q$$

in which R'''' represents an alkyl group containing 6–12 carbon atoms, R''' represents an alkyl group containing 1–4, carbon atoms and $p$ and $q$ represent whole numbers from 0–2 and 2–4, respectively, with the proviso that $p+q=4$, said monocarboxylic acid ester having an acid number and hydroxyl value less than 8.

5. The method of claim 4 wherein the ester lubricant is applied to the fiber as an aqueous emulsion.

* * * * *